US006517655B1

(12) United States Patent
Spencer et al.

(10) Patent No.: US 6,517,655 B1
(45) Date of Patent: Feb. 11, 2003

(54) METHOD AND APPARATUS FOR MAKING AN ALBUM LEAF

(75) Inventors: Timothy F. Spencer, Rochester, NY (US); Thomas W. Glanville, Churchville, NY (US); John A. Cogswell, Arlington Heights, IL (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/667,952

(22) Filed: Sep. 22, 2000

(51) Int. Cl.[7] ..... B31F 1/00

(52) U.S. Cl. ..... 156/227; 156/443; 156/517; 156/538; 493/417; 493/424; 493/434

(58) Field of Search ..... 156/538, 517, 156/510, 227, 217, 443; 493/416, 417, 418, 419, 434, 424, 436, 420

(56) References Cited

U.S. PATENT DOCUMENTS 3,411,767 A 11/1968 Moser et al.
3,870,292 A 3/1975 Bradley
4,036,487 A 7/1977 Heimlicher et al.
4,188,254 A 2/1980 Hempler, Jr.
4,878,974 A 11/1989 Kagawa
5,403,138 A * 4/1995 Otake et al. ..... 281/21.1
5,791,692 A 8/1998 Manico et al.
5,842,964 A * 12/1998 Huber et al. ..... 493/417
5,957,502 A 9/1999 Manico et al.
6,004,061 A 12/1999 Manico et al.
6,173,992 B1 * 1/2001 Manico et al. ..... 283/38

* cited by examiner

*Primary Examiner*—Michael W. Ball
*Assistant Examiner*—John L. Goff
(74) *Attorney, Agent, or Firm*—Frank Pincelli

(57) ABSTRACT

An apparatus and method for automatically folding a sheet of a media, for example a photographic paper, about a fold line such that a album page is formed. The photosensitive media has images only on one side. A heat activated adhesive sheet is provided between the sides of the photographic paper during folding. The adhesive sheet when exposed to heated and pressure rollers will cause the sides of the photographic media to be secured to form a single album page.

31 Claims, 12 Drawing Sheets

METHOD AND APPARATUS FOR MAKING AN ALBUM LEAF

FIELD OF THE INVENTION

The present invention is directed to an apparatus and method for automatically folding a sheet of a media, for example, a photographic paper, about a fold line such that an album page is formed. The photosensitive media has images only on one side. A heat activated adhesive sheet is provided between the sides of the photographic paper during folding. The adhesive sheet when exposed to heated and pressure rollers, will cause the sides of the photographic media to be secured to form a single album page.

The present invention relates to a method and apparatus for making an album leaf, preferably out of photographic paper.

BACKGROUND OF THE INVENTION

In a typical photofinishing lab photographic prints are made using a mini-lab or a high volume printer. In a high volume printer the prints are produced on a roll of photographic paper whereas in a mini-lab the prints may be made on cut sheets or from a roll of photographic paper that is cut into individual prints. It is know from U.S. Pat. Nos. 6,004,061; 5,957,502; and 5,791,692 that album pages can be made by folding a cut sheet of material such as photographic paper and adhesively securing the folded sides together. While the technique of folding the sheet produces an excellent product, there is a need to be able to make photographic album pages in a high volume, low cost environment. In particular there is a need to produce album leafs from photographic paper produced either by high speed photographic printers or mini-labs.

SUMMARY OF THE INVENTION

In one aspect of the present invention there is provided an apparatus for making an album leaf from an image bearing sheet having an image bearing side and a non-image bearing side, comprising:

a supply of adhesive sheet material;

a second roller positioned adjacent the first roller so as to form a first nip there between, the second roller is used for driving the adhesive sheet into the first nip against the image bearing sheet that is driven by the first roller; and a third roller positioned adjacent the first roller so as to form a second nip there between, the third and the first roller moving in a direction which causes the image bearing sheet to be folded firmly about the adhesive sheet and moved through the second nip so as to form an album leaf.

In accordance with another aspect of the present invention there is provided a method for making an album leaf, comprising the steps of:

providing an image bearing sheet having an image bearing side having a first image section and a second image section separated by a fold line;

providing a supply of adhesive sheet material;

providing a second roller for transporting of the adhesive sheet having a leading edge, the first roller and the second roller being position adjacent each other so as to form a first nip;

providing a third roller for transporting of the sheet and the adhesive sheet, the first roller and the third roller being position adjacent each other so as to form a second nip;

transporting the image bearing sheet using a first roller and the adhesive sheet using a second roller in the same direction through the first nip so that the leading edge of the adhesive sheet is substantially aligned with the fold line during transporting;

disengaging the adhesive sheet from the second roller onto the image bearing sheet;

moving the first and third rollers so that the image bearing sheet is folded about the fold line so as to form the album leaf.

In accordance with yet another aspect of the present invention, there is provided a method for making an album leaf from an image bearing sheet using a first roller, a second roller, and a third roller, the first roller and the second roller being positioned adjacent each other so as to form a first nip, the first roller and the third roller being positioned adjacent each other so as to form a second nip, the image bearing sheet having a first image section and a second image section, the first image section being separated from the second image section by a fold line, comprising the steps of:

feeding the image bearing sheet through the first nip using the first roller;

feeding an adhesive sheet through the first nip using the second roller, the adhesive sheet having a leading edge, the first and second roller being driven so that the leading edge is substantially aligned with the fold line;

disengaging the adhesive sheet from the second roller;

feeding the image bearing sheet and the adhesive sheet into the second nip so as to fold the image bearing sheet about the adhesive sheet.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
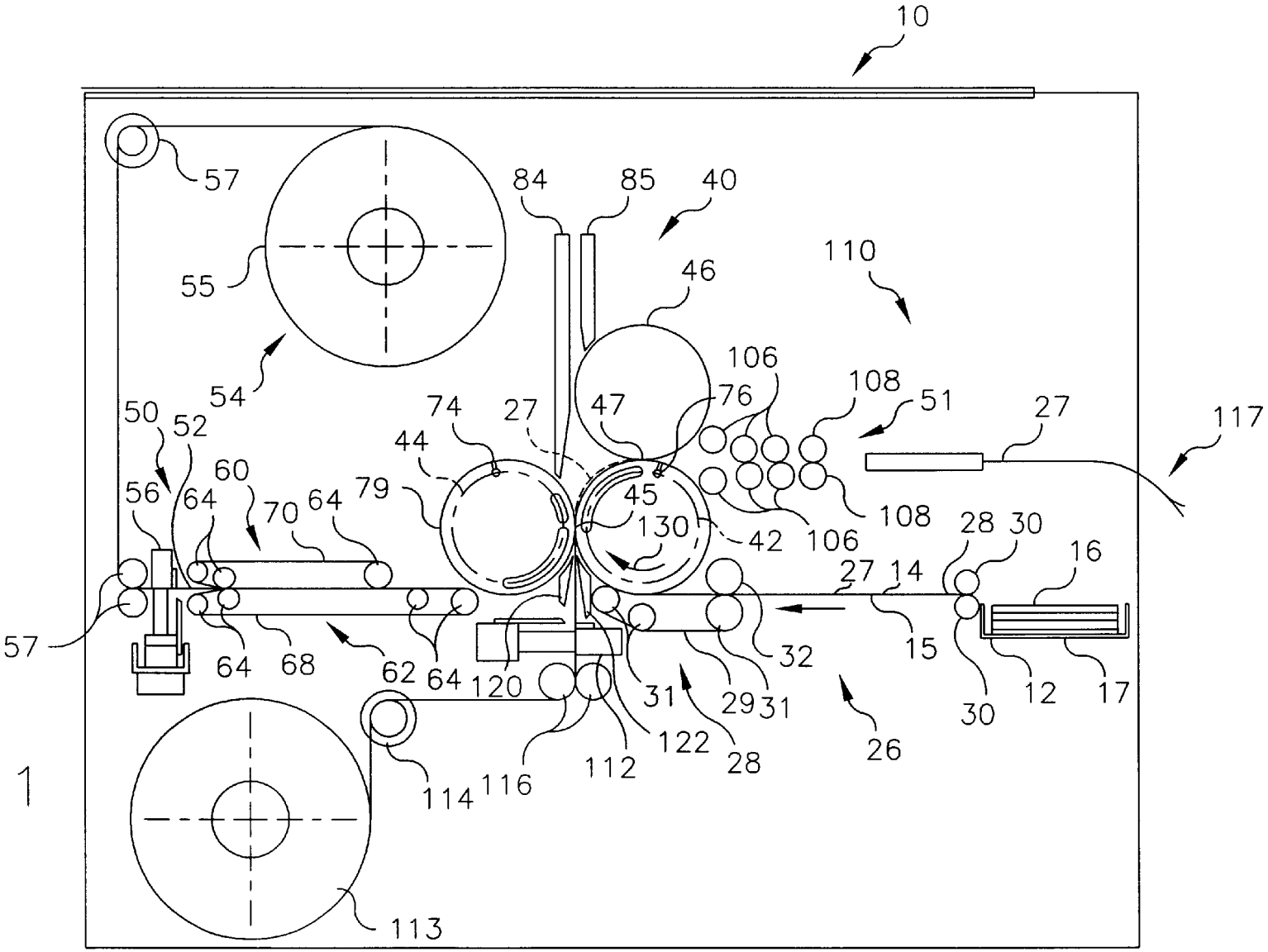
FIG. 1 illustrates an elevational view of an apparatus made in accordance with the present invention.
Figure 11:
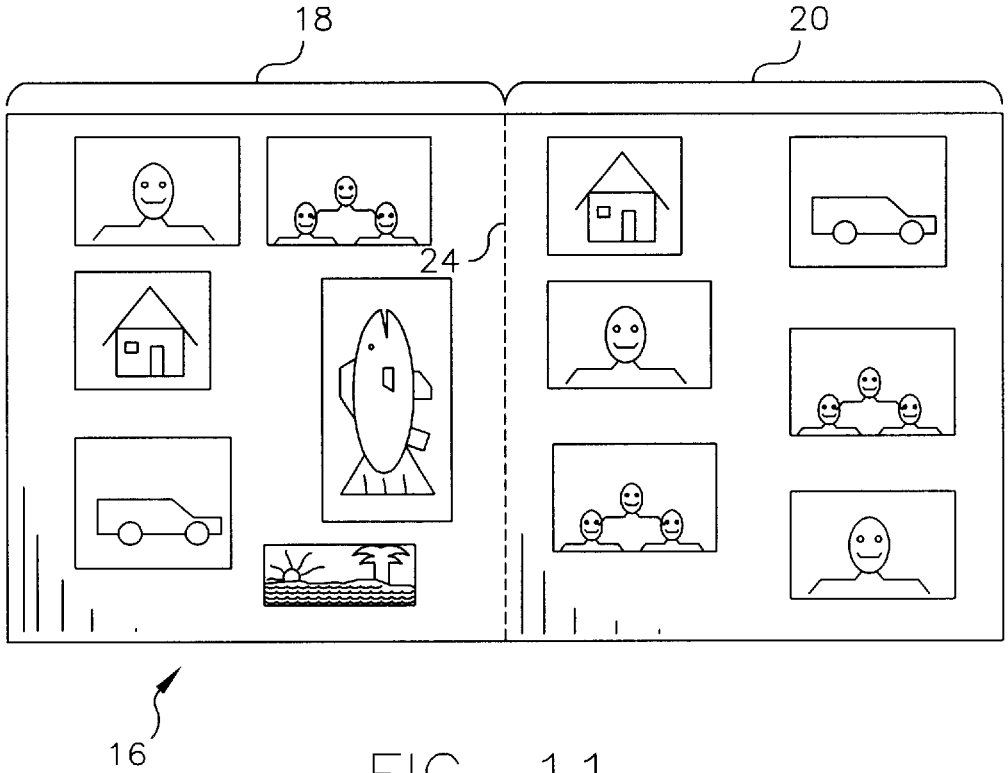
FIG. 11 illustrates a plan view of a sheet of media that is to be folded so as to form an album leaf.

Referring to FIG. 1 there is illustrated an apparatus 10 made in accordance with the present invention and FIGS. 2–10 illustrates in sequence the various stages of folding a cut sheet to form an album leaf made in accordance with the present invention. The apparatus 10 includes a first supply of a media 12 having an image bearing side 14 and a back side 15. The back side 15 typically being a non-image bearing side. In the particular embodiment illustrated the media 12 is provided as a cut sheet 16 as illustrated by FIG. 11. The cut sheet 16 is obtained from a supply bin 17 in which a plurality of sheets 16 have been placed. The image bearing side 14 of sheet 16 has been printed thereon so as provide a first image section 18 and a second image section 20 in which images have been provided. In the particular embodiment illustrated the media 12 comprises photographic paper. The image section 18 and second image section 20 are separated by fold line 24. The images sections 18, 20 will be folded about fold line 24 so a to form an album page as discussed later herein. The fold line 24 is not necessarily a visible line, but simply indicates a line about which the image sections 18, 20 will be folded. In the embodiment illustrated, there is no visible fold line 24, therefore the fold line 24 is shown by dash lines. An appropriate transport mechanism 26 is provided for transporting of the sheet 16 from supply bin 17 along processing path 27. In the embodiment illustrated the transport mechanism 26 comprises a drive belt assembly 28 and pair of pinch roller 30. It is to be understood that any appropriate transport mechanism may be used to move the media along the processing path 27. The drive belt assembly 28 comprises a belt 29 wrapped about rollers 31 and pressure rollers 32. It is of course to be understood that any appropriate transport mechanism may be used for transporting of the sheets 16.

The sheet 16 is advanced to the folding mechanism 40. The folding mechanism 40 includes a first roller 42 and second roller 44 which are positioned so as form a first nip 45. The mechanism 40 further includes a third roller 46 positioned with respect to the first roller 42 so as to form a second nip 47.

An adhesive delivery mechanism 50 is provided for providing an adhesive sheet 52 to the folding mechanism 40. The adhesive delivery system 50 includes a first supply 54 of an adhesive media which in the particular embodiment illustrated is provided in the form of roll 55. The adhesive media may be of any desired type that will allow the adhesion of the folded sheet 16. In the particular embodiment illustrated the adhesive media is Trimount Material Manufactured by the DryTac Corporation. The media from roll 55 is guided to a cutter 56 by guide rollers 57. A cutter 56 is provided for cutting the roll 55 in to individual sheets 52 of predetermined length. A pair of drive belt assemblies 60, 62 are provided for transporting the cut adhesive sheet 52 from the cutter 56 to the folding mechanism 40 where it will be placed in the fold of the media sheet 16 as discussed later herein. In the embodiment illustrated the drive belt assemblies 60, 62 each comprise a plurality of rollers 64 about which drive belts 68, 70 respectively is provided. At least one of the rollers 64 is a drive roller which is connect to an appropriate drive motor (not shown) for moving the belts 68, 70 in the appropriate direction.

Figure 7:
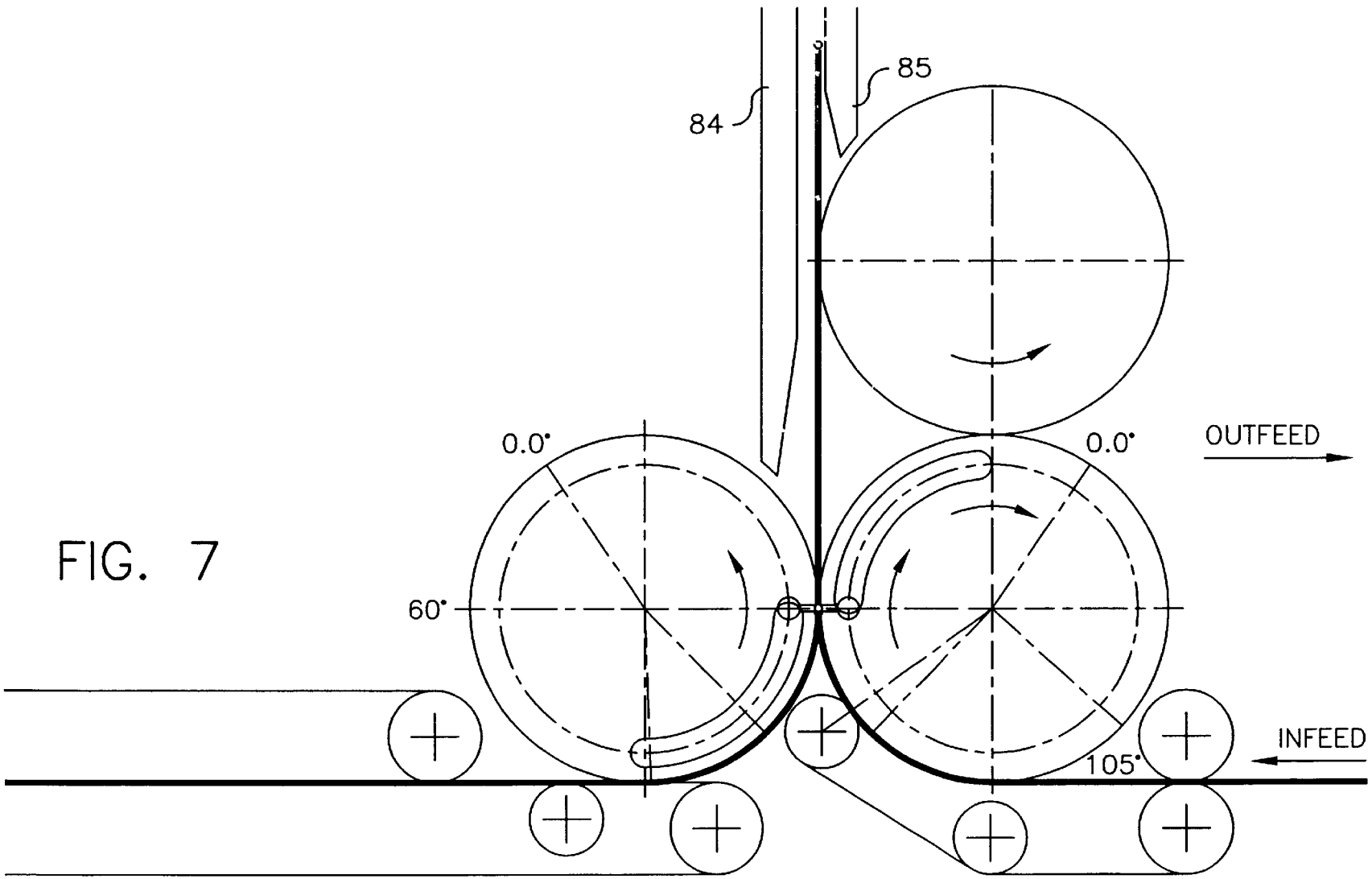
Figure 8:
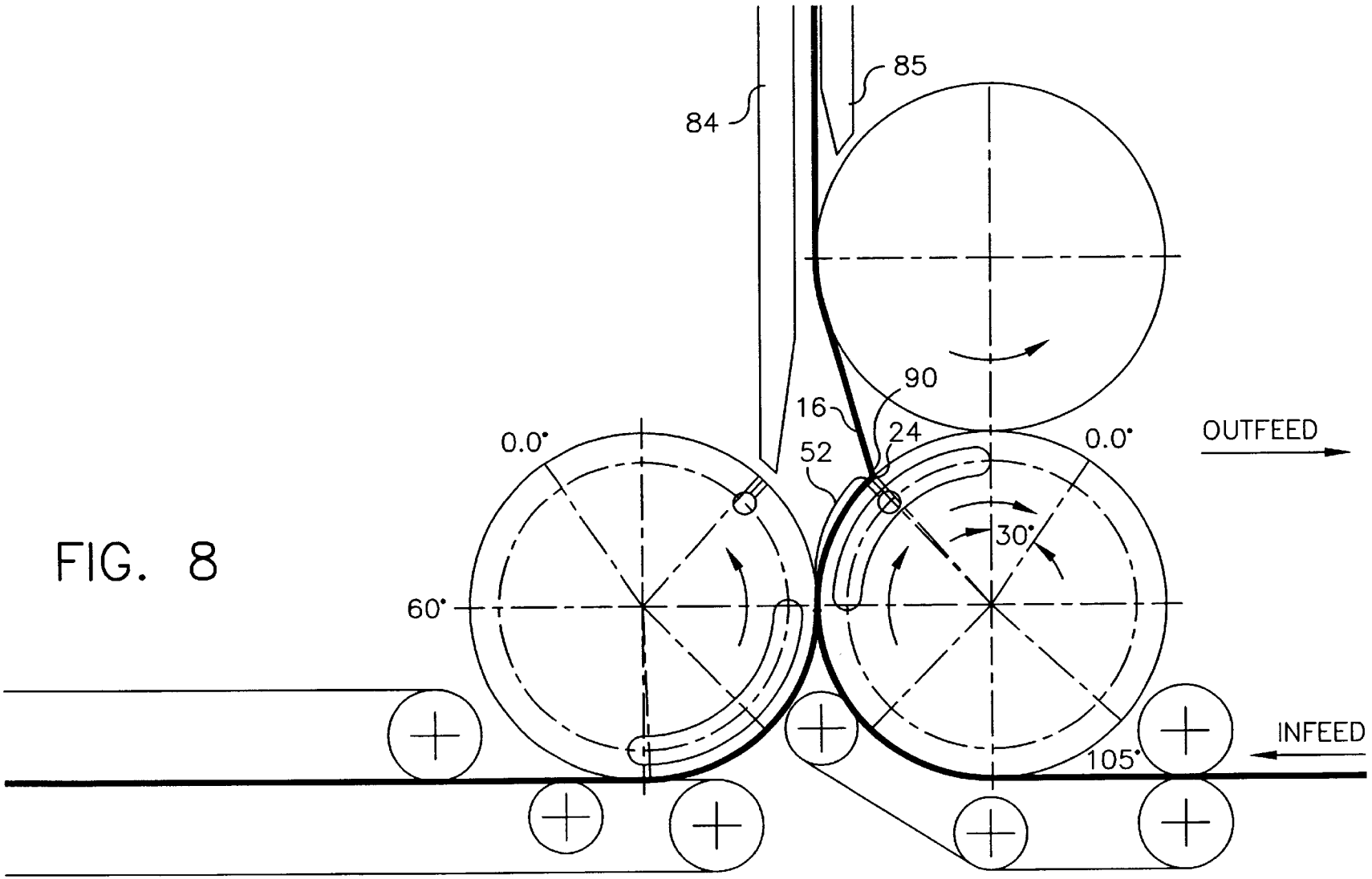
Figure 9:
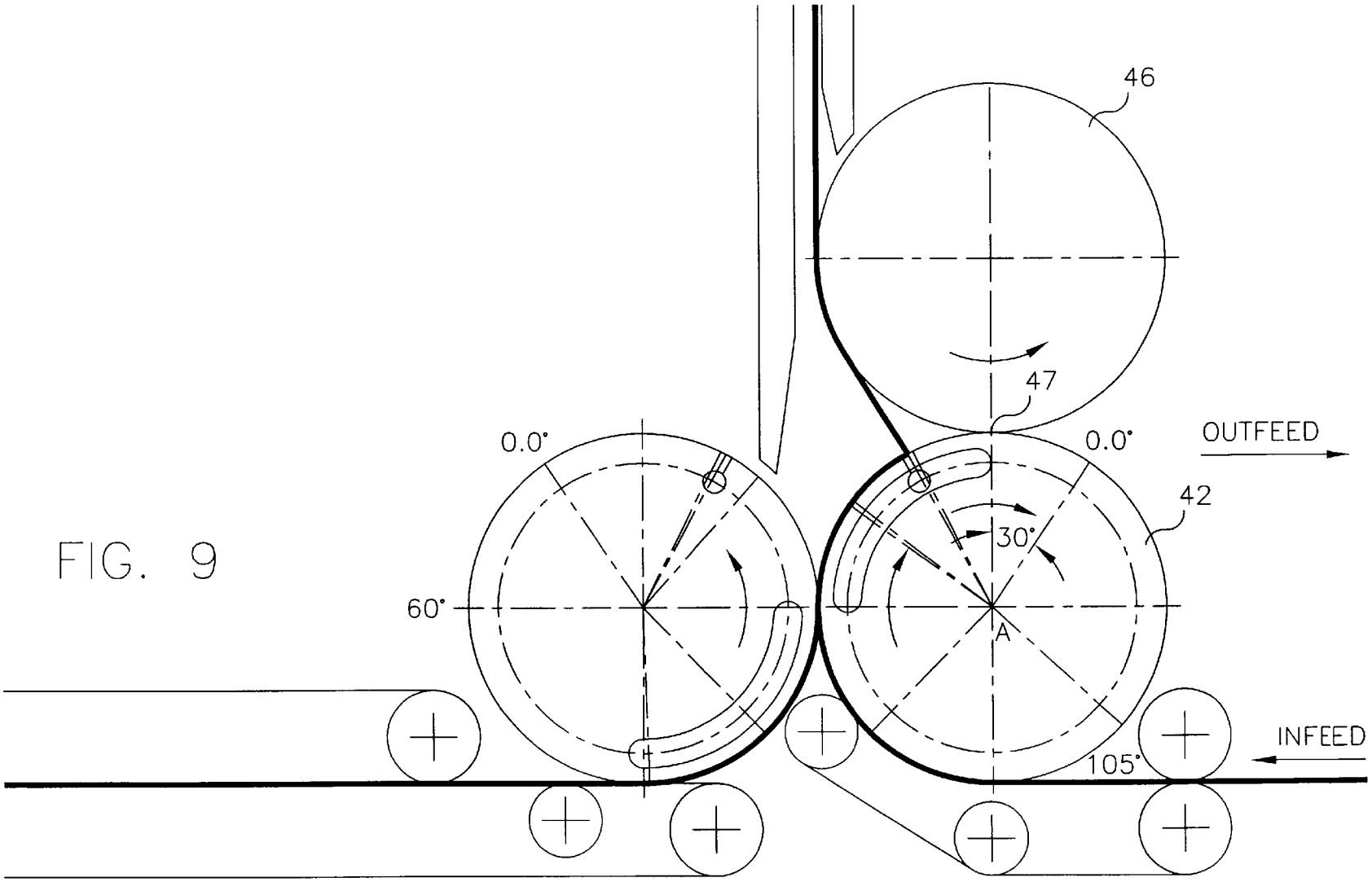
Figure 10:
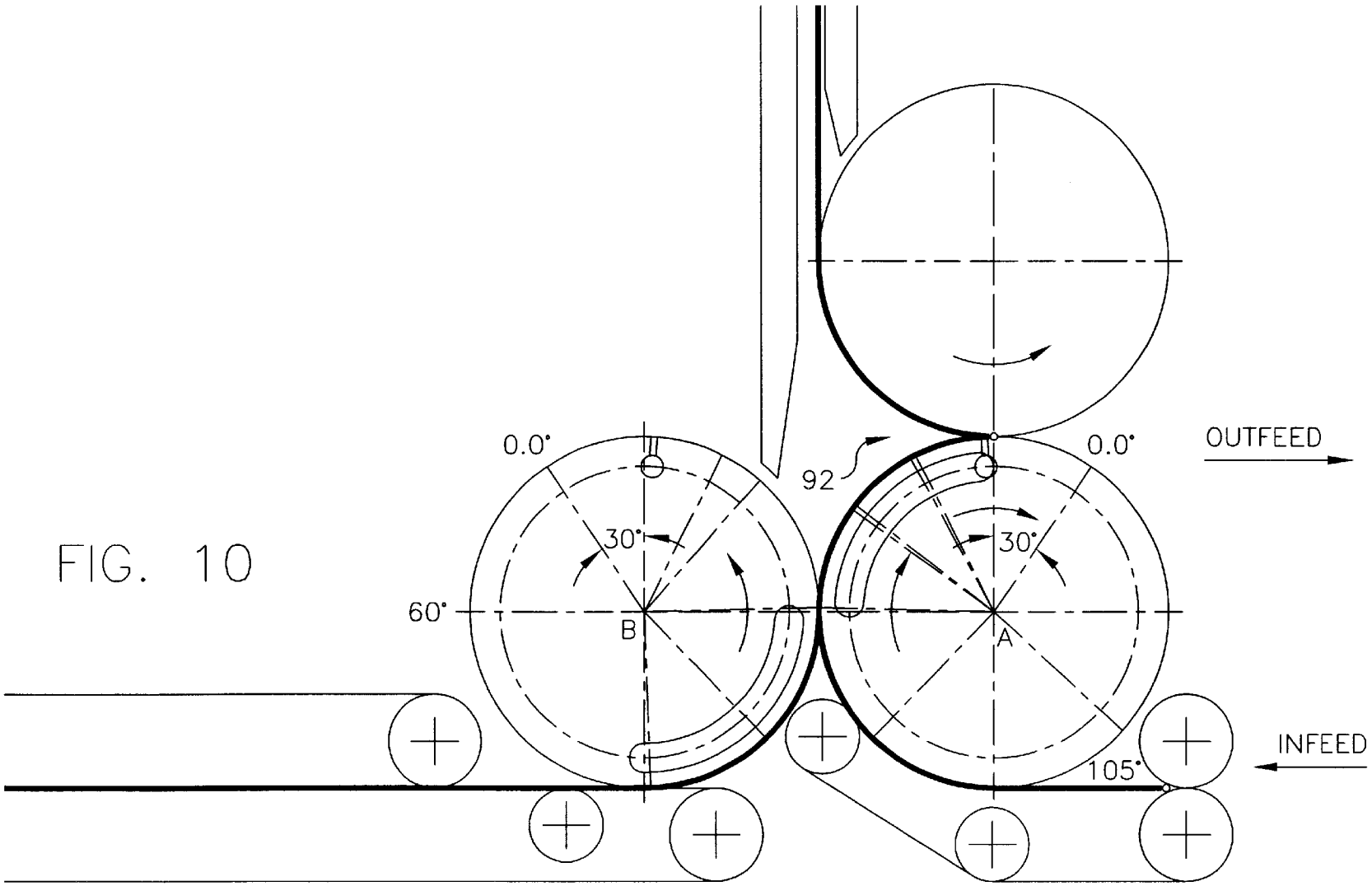

The adhesive sheet 52 is delivered adjacent second roller 44. Second roller 44 is provided with an appropriate holding mechanism for picking up the adhesive sheet 52 and delivering it to nip 45. In the embodiment roller 44 is provided with a plurality of openings (not shown) which are connected to a vacuum source (also not shown) so as to provide a line of vacuum across the adhesive sheet 52 for transporting the adhesive sheet 52 about roller 44. The source of vacuum is disengaged from the openings so as to release the sheet 52 once the sheet 52 has been delivered to the nip 45. Thereafter, the openings are internally switched to a compressed air supply which forces the adhesive sheet 52 off roller 44 and into the second nip 47. The roller 44 is also provided with a projection 74 which is designed to engage a recess 76 provided in roller 42 at the appropriate location on sheet 16 (see FIG. 4). Preferably as illustrated, the rollers 42, 44 are synchronized such that the projection 74 and recess 76 align with the fold line 24 in sheet 16 as illustrated by FIG. 7. The adhesive delivery system and rollers 42 and 44 are also synchronized such that the leading edge 78 of the adhesive sheet 52 is placed at or just short of the fold line 24. Preferably the outer surface 79 of roller 44 is made of a material that will not stick to the adhesive sheet 52. In the particular embodiment illustrated, the roller is made of 1144 steel with a black oxide coating.

The nip 45 is designed such that it is provided sufficient pressure so that the adhesive sheet 52 will adhere to sheet 16. In the embodiment illustrated, a burst of air provided by the opening is provided for assisting in transfer of the sheet 52 to sheet 16.

The first roller 42 and the second roller 44 continue to roller rotate to drive sheet 16 and attached adhesive sheet 52 toward roller 46 along guide plates 84, 85. At the appropriate time, roller 46 is activated so that it moves the first image section toward the second nip 47 as illustrated by FIGS. 7–10. Since first and second rollers 42, 44 continue to rotate, a folded edge 90 is formed and is driven into nip 47 thereby folding sheet 16 to form album leaf 92. A sufficient degree of force is applied to leaf 92 by rollers 44, 46 so that the first and second image sections 18, 20 are secured together with out any perceivable damage to the leaf 92. The degree and amount of pressure necessary will vary upon a number of different factors, for example, the thickness of the sheet 16, the thickness of the adhesive sheet 52 and the physical properties of the sheets, 16, 18.

After the folding operation, the leaf 92 is sent to a sealing station 51. In the particular embodiment illustrated, the adhesive in adhesive sheet 52 is not bonded until the application of heat and a small amount of pressure. Therefore the leaf 92 (see FIG. 12) is passed through a plurality of heating pressure rollers 106 for permanently sealing of leaf 92. The degree and amount of heat and pressure will vary on a variety of factors. The amount of heat and pressured applied is such so as not to perceivably damage or affect the images on the leaf 92 yet sufficient to secure the sides together. In the embodiment illustrated, the leaf 92 is heated to a temperature no greater than about 200 degree F. (C). A pair of cooling rollers 108 is provided so as to cool the leaf 92 after passing through heating rollers 106. It is to be understood that depending upon the type of adhesive being used, heat or a separate pressure application may not be needed.

Figure 12:
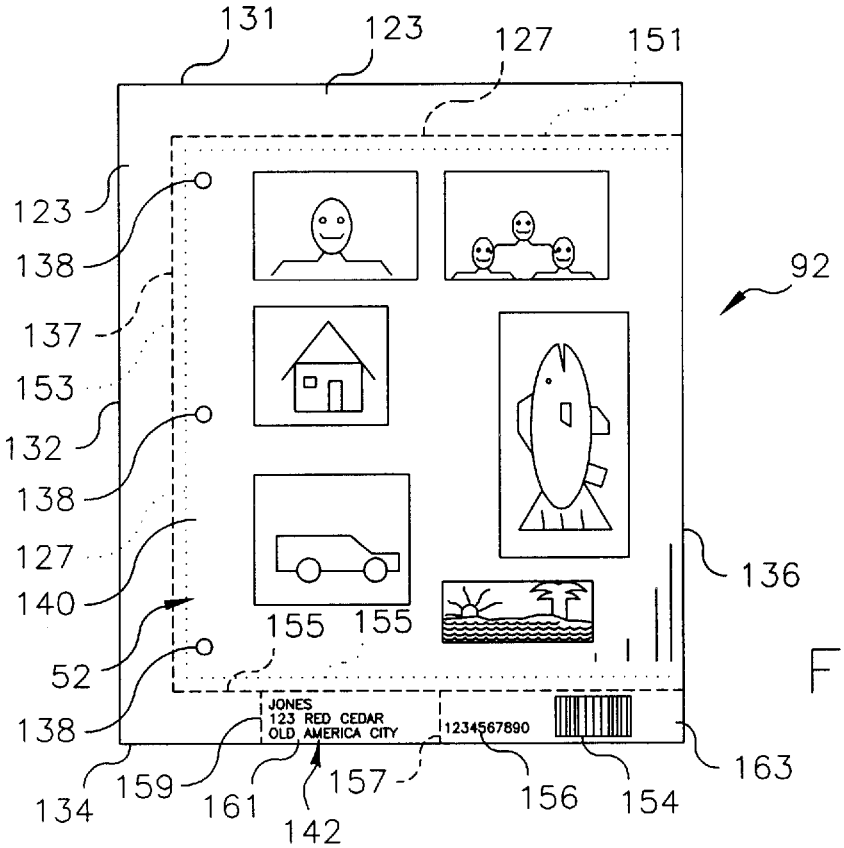
FIG. 12 illustrates the sheet of FIG. 11 after it has passed through the trimming section of the apparatus of FIG. 1.
Figure 13:
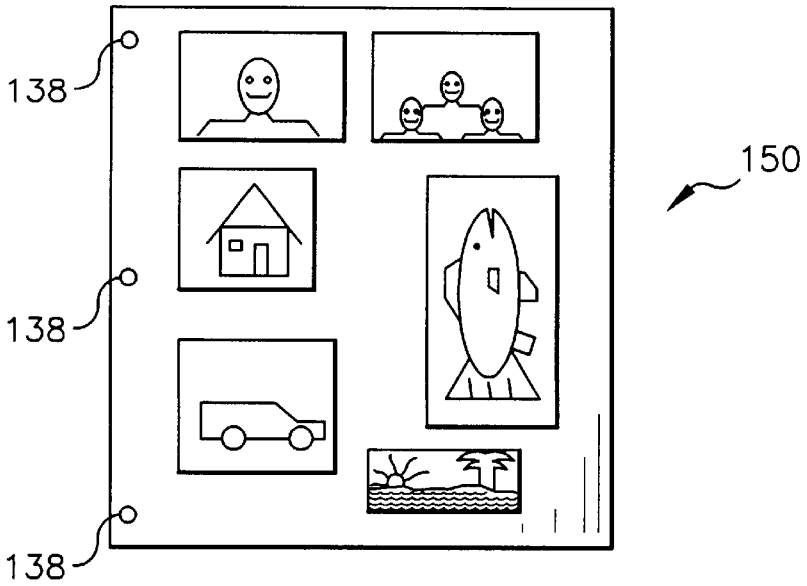
FIG. 13 illustrates the album leaf of FIG. 12 after the trimmed material is removed.

The leaf 92 is forward from sealing operation to a finishing station 110 where certain finishing operations are provided. FIG. 12 illustrates an album leaf 92 that has been subjected to the trimming operation. In the embodiment illustrated, the edges of the leaf 92 are trimmed so as to provide a finished leaf 150 as illustrated by FIG. 13. FIG. 12 illustrates the trimmed section 123 that is to be removed from leaf 92. The short dash lines 127 of FIG. 12 illustrates the outer periphery of the finished leaf 150 that will be made from leaf 92. Preferably as illustrated, only the cut edges 131, 132 and 134 of the leaf 92 are trimmed leaving the folded edge 136 untouched. Additionally, the trimmed section cuts through the outer periphery 137 of the adhesive sheet 52 so that the edges of the leaf 150 (see FIG. 13) will be sealed together. Optional holes 138 may be provided in a margin area 140 so that the finished leaf 150 may be placed in a ring binder. It is of course to be understood that any desired finishing operation may be provided, including but not limited to, the providing of other means for securing the leaf to a book, binder, or binding multiple sheets together forming a booklet, etc. Also as illustrated by FIG. 13, an optional ID section 142 may be provided which may include customer order identification information so that the finished leaf 92 can be easily identified with a customer order. Several line perforations 151, 153, and 155 are provided which forms part of the outer periphery 127 of leaf 150. Also lines of perforations 157 and 159 are provided for forming removable sections 161 and 163 which contains information. The information may be in the form of a machine readable code 154 and/or in a human readable form 156. Once the leaf 92 is associated with the customer order, the ID section 142 may be removed by simply tearing it off from leaf 92. The information may also include customer address so that the ID section as illustrated in section 161 can be used as an address label. It is of course understood that any desired information may be provided in sections 161, 163 and be used for any desired purpose by the photofinisher or customer. In the embodiment illustrated, the section 161 may be used as a mailing label and section 163 is used for sorting the finished album leaf with the customer order.

In the embodiment illustrated, the media 12 is not limited to being provided in cut sheets 16. Alternatively, or in combination with the sheets 16, media may also be provided in the form a roll 113 as illustrated. When the media is so provided, the roll 113 of media is sent to a cutter 112 where the media is cut into individual sheets 16. Guide roller 114 and drive rollers 116 are provided for feeding of the media from roll 113 to rollers 42, 44 and cutter 112. A pair of guide members 120, 122 (see FIG. 1) is provided for guiding the media into nip 45. The rollers 42, 44 operate in much the same way as previously discussed.

Figure 2:
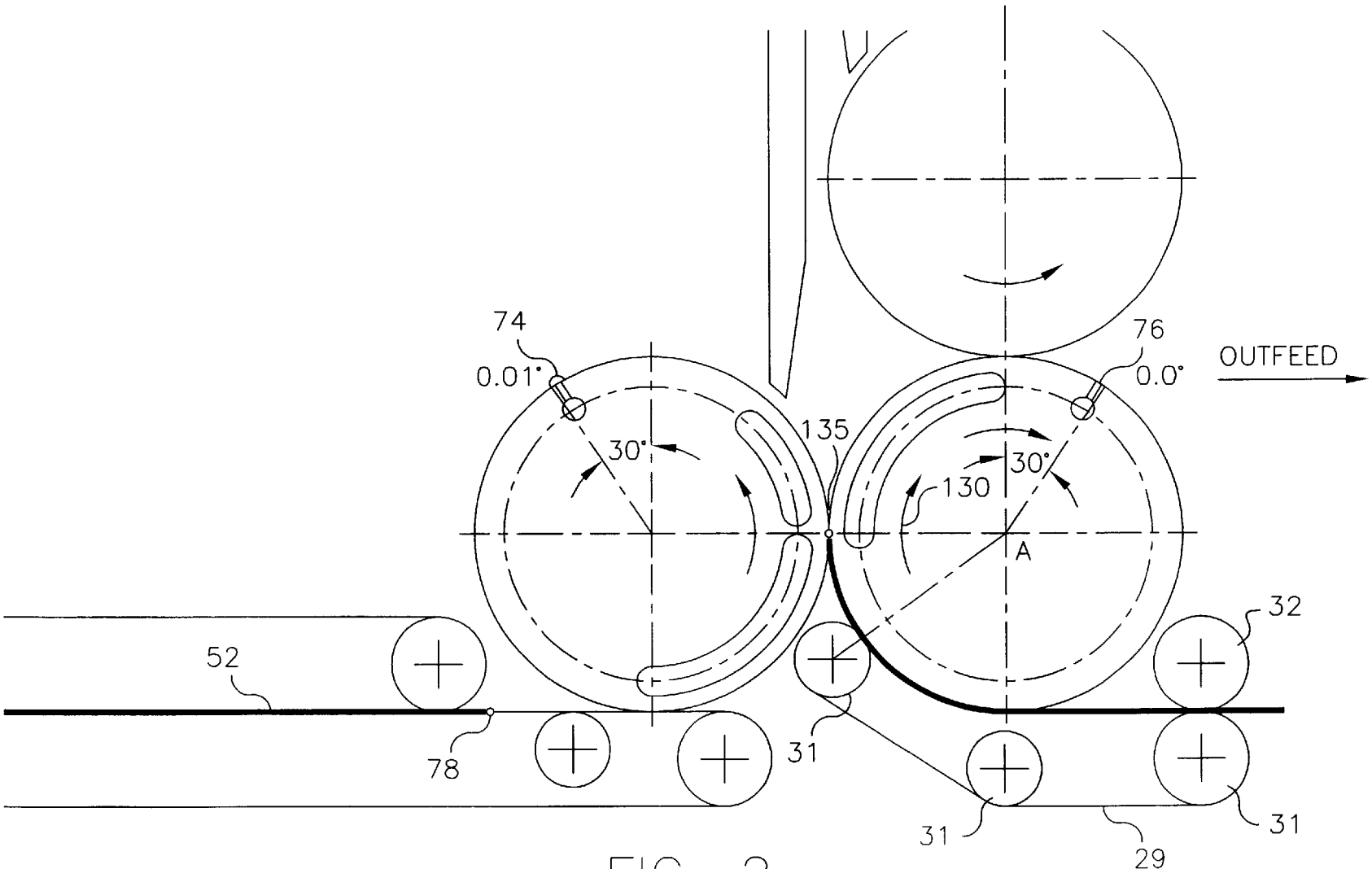
FIGS. 2–10 illustrate an enlarged view of the folding section of the apparatus of FIG. 1 showing the sequence of steps used in the folding of a sheet of media.
Figure 3:
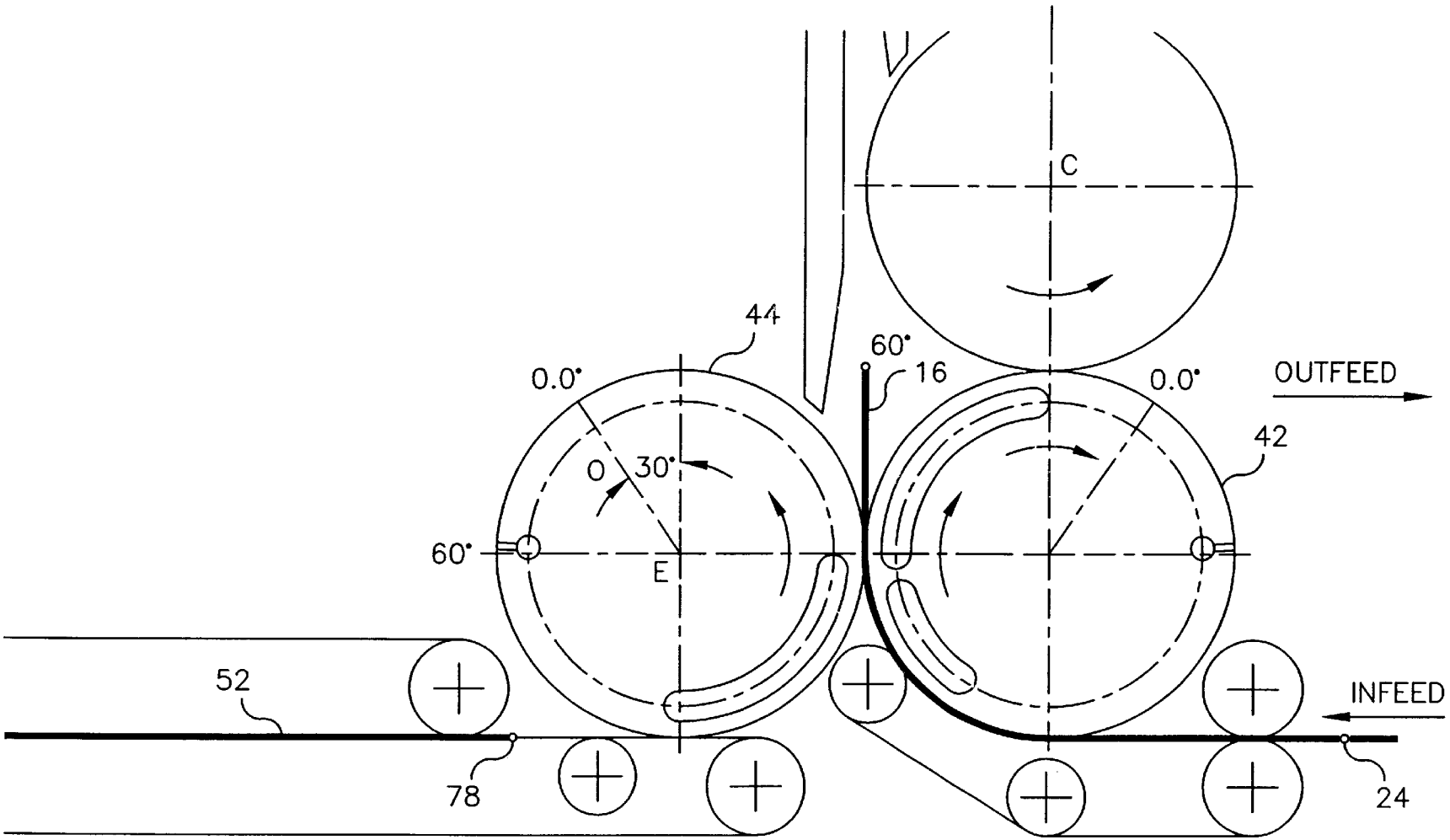
Figure 4:
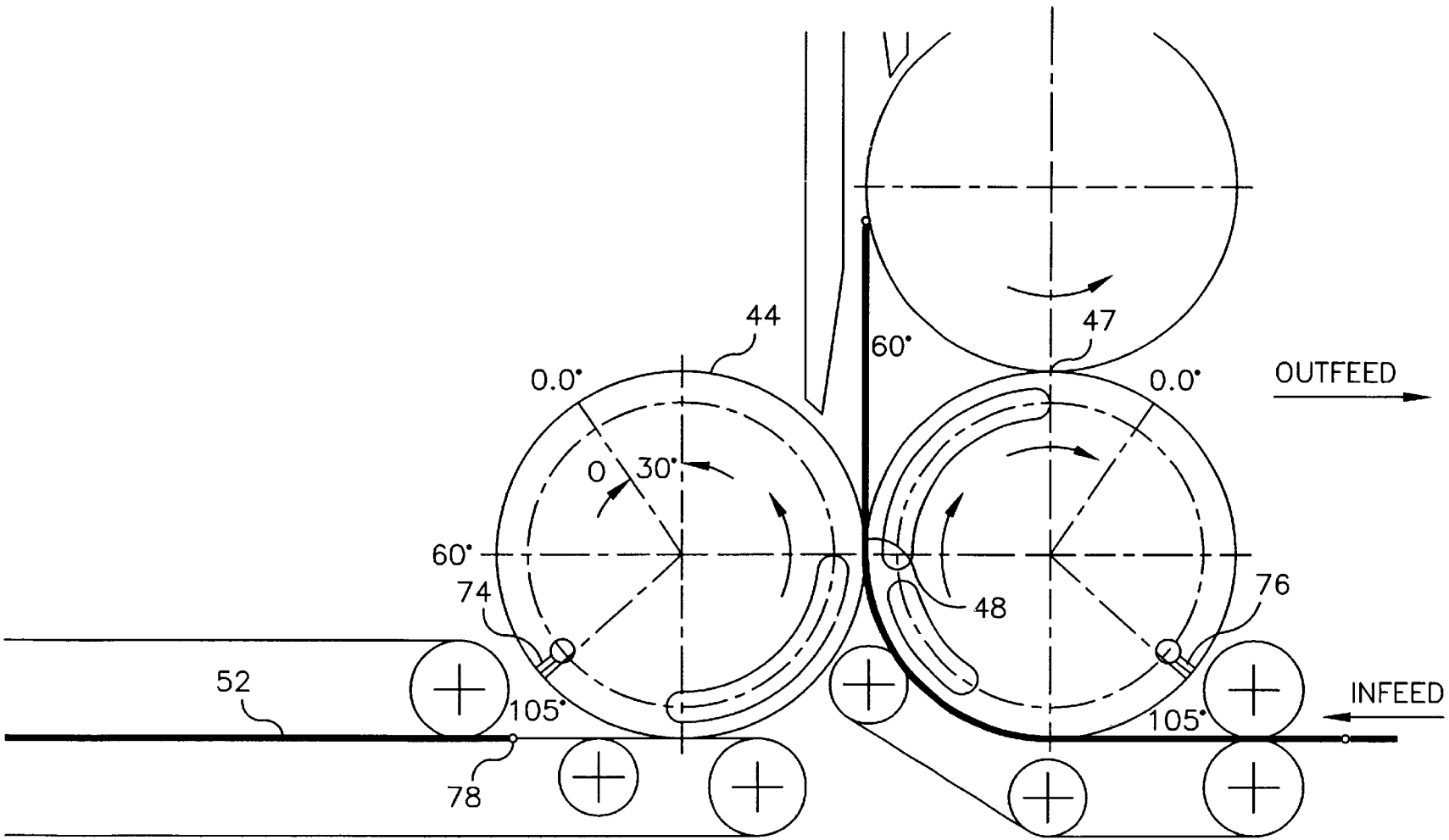
Figure 5:
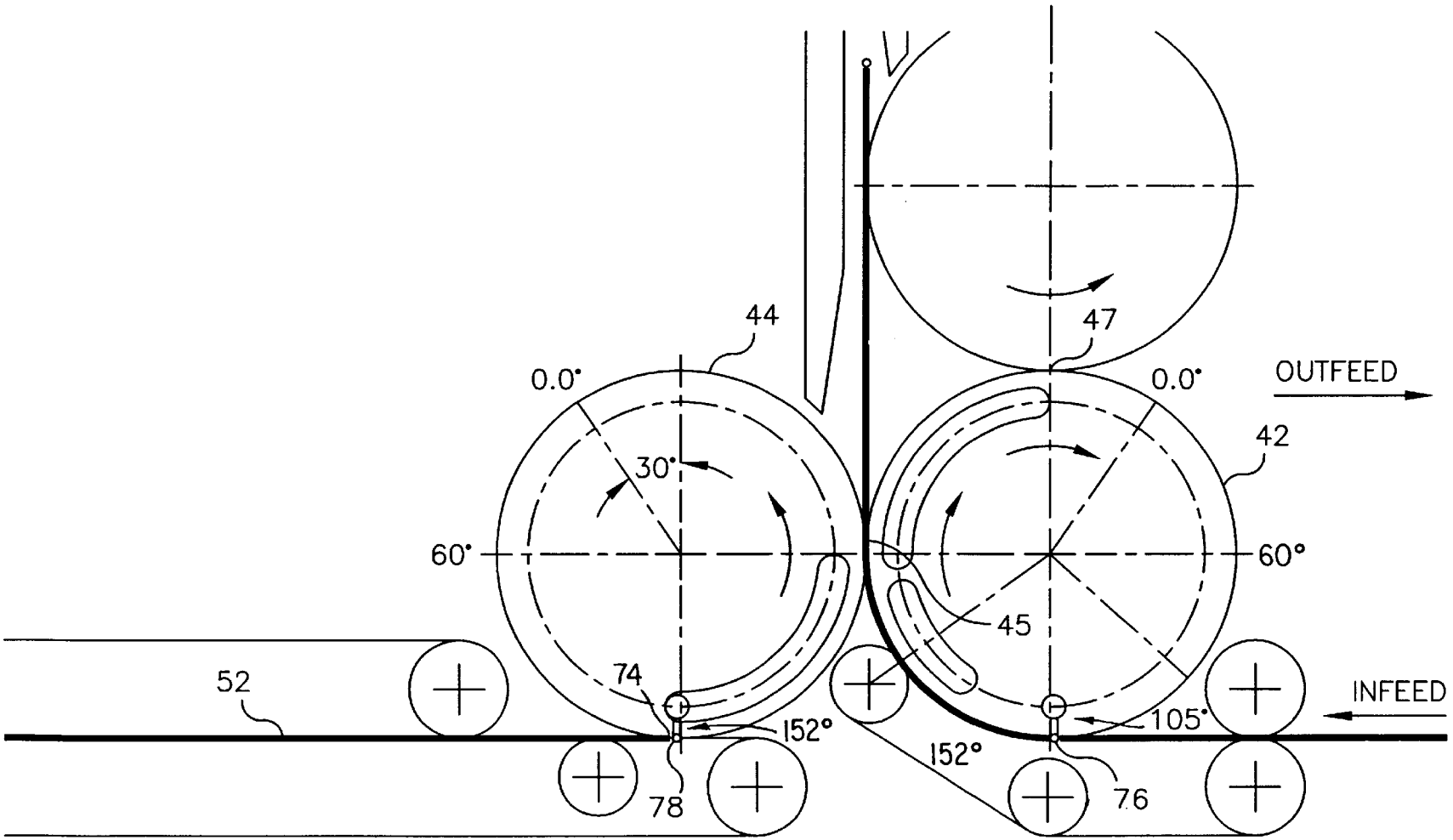
Figure 6:
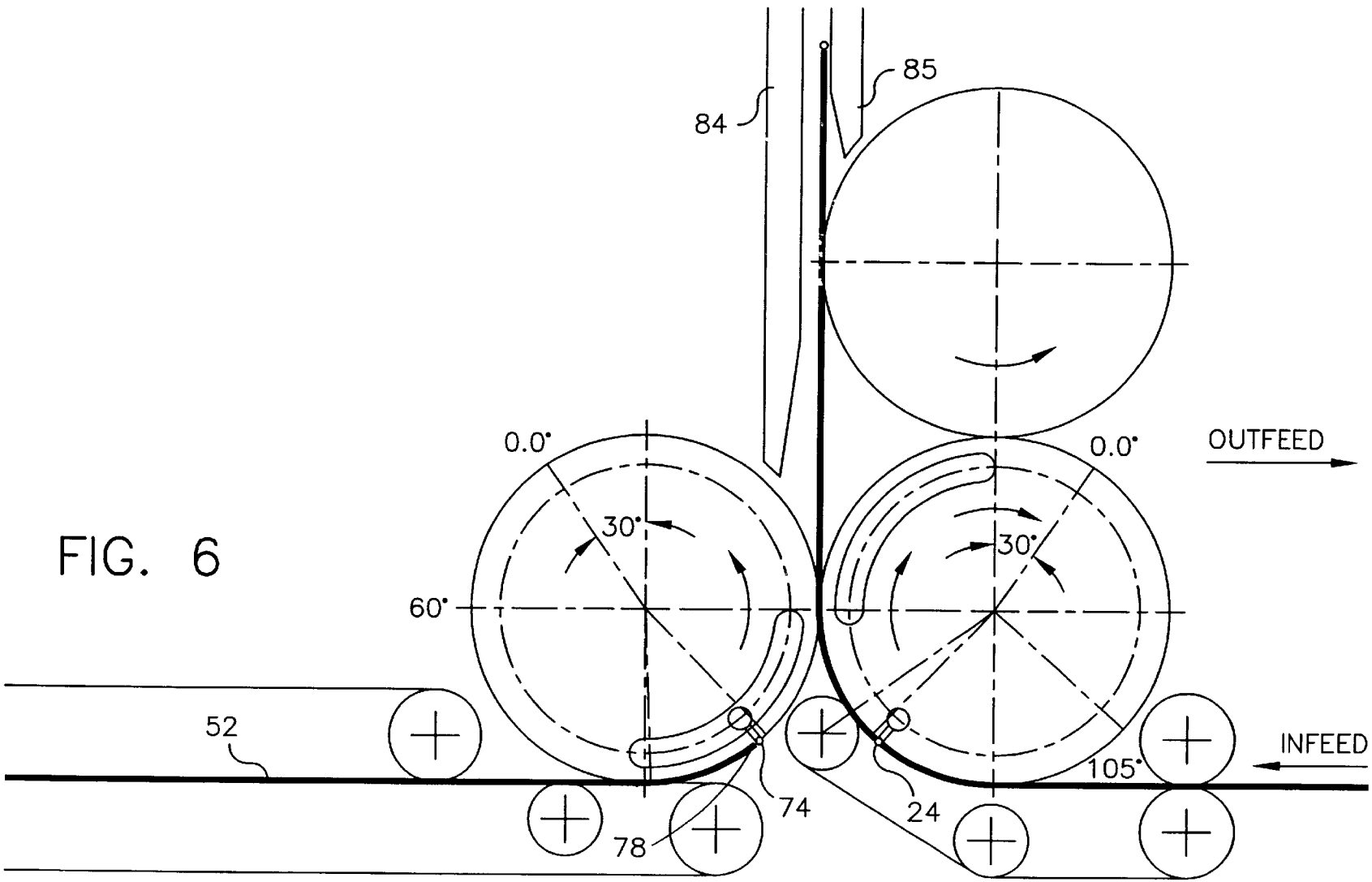

In order to better understand the present invention, a description of the operation of apparatus 10 using a cut sheet 16 from bin 17 will now be discussed. Referring to FIG. 1, an initial sheet 16 is transported from bin 17 to nip 45. The roller 42 is rotated in the direction indicated by arrow 130. Sheet 16 is moved in synchronization with roller 42 such that the leading edge 132 of sheet 16 will align with a predetermined point 135 on roller 41 as illustrated by FIG. 2. An adhesive sheet 52 is also moved in synchronization with the movement of sheet 16 so that the leading edge 78 aligns with a predetermined point 74 on roller 44 (see FIG. 5). The rollers rotate such that the projection 74 on roller 44 will engage the recess 76 on roller 42 and form a crease line that substantially coincides with fold line 24 as illustrated by FIG. 7. The adhesive sheet is placed at or just behind the fold line as illustrated by FIG. 7. The shape of the sheet 52 is substantially the same as the folded sheet but preferably slightly smaller in size so that the adhesive material on adhesive sheet during the sealing operation will not flow out the edges as illustrated by FIG. 12. The roller 42, 44 are rotated to move the sheet 16 and sheet 52 through nip 45 (see FIGS. 4–6). At the appropriate time the roller 46 is rotated to cause the sheet 16 to be folded about adhesive sheet 16 and passed through nip 47 as illustrated by FIGS. 7–10.

Figure 14:
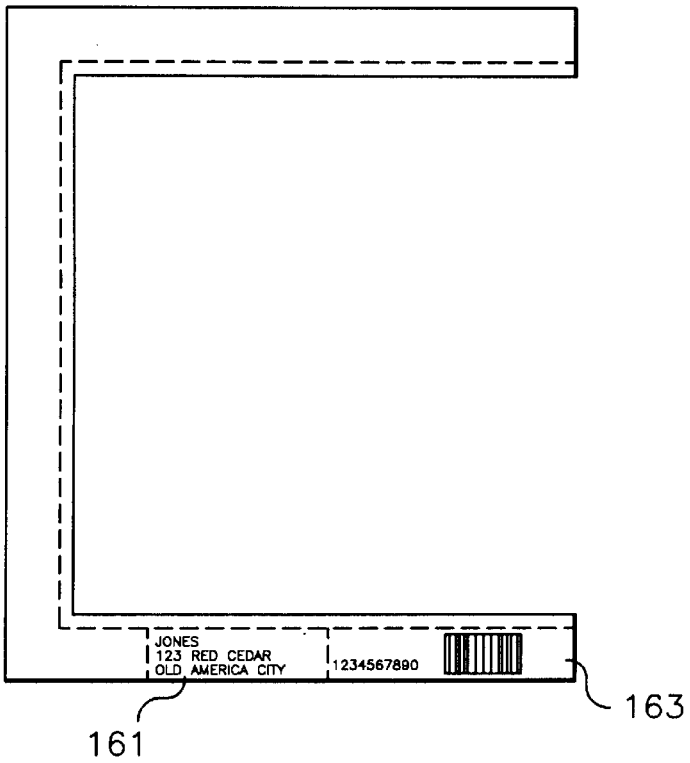
FIG. 14 illustrates the trimmed material that has been removed.

The album leaf 92 is then passed through the sealing station where heat and pressure is applied followed by cooling by rollers 108. The album leaf 92 is then sent to the trimming station where final finishing operations are applied to the leaf 92. Thereafter the leaf 92 is placed in bin 117. Thereafter the trimmed material, as illustrated by FIG. 14, is removed as needed. Thereafter the leaf 92 is placed in the normal return process of the lab where it is being made for eventual return to the customer.

The same process is used when a roll 113 of media is provided except that the roll passes through by cutter 112. Before cutter 112 is activated, the sheet first passes through nip 45 so that rollers 42, 44 can take care of feeding the sheet 16 through the folding operation. The roll 113 will be cut by the cutter at the appropriate time. For example appropriate cutting marks may have been provided on the roll 113 during printing for activating the cutter 112 at the appropriated location and for activating movement of the roll 113 at the appropriate times. The remaining parts of apparatus 10 operate in the same manner as previously discussed.

The invention has been described in detail with particular reference to certain preferred embodiments thereof, but it will be understood that variations and modifications can be effected within the spirit and scope of the invention.

PARTS LIST

10 apparatus
12 media
14 image bearing side
15 back side
16 sheet
17 supply bin
18 first image section
20 second image section
24 fold line
26 transport mechanism
27 processing path
28 drive assembly
29 belt
30 rollers
31 rollers
32 pressure roller
40 folding mechanism
42 first roller
44 second roller
45 nip
46 third roller
47 second nip
50 adhesive delivery mechanism
51 sealing station
52 adhesive sheet
54 first supply
55 roll
56 cutter
57 guide rollers
60 drive belt assemblies
62 drive belt assemblies
64 rollers
68 drive belt
70 drive belt
74 projection
76 recess
78 leading edge
79 surface
84 guide plates
85 guide plates
90 folded edge
92 album leaf
106 pressure rollers
108 cooling rollers
110 finishing station
112 cutter
113 roll
114 guide roller
116 drive rollers
117 bin
120 guide member
122 guide member
123 trimmed section

127 short dash lines
130 arrow
131 cut edges
132 cut edges
134 cut edges
135 predetermined point
136 folded edge
137 outer periphery
138 holes
140 margin area
142 ID section
150 finished leaf
151 line perforation
153 line perforation
154 machine readable code
155 line perforation
156 human readable code
157 line perforation
159 line perforation
161 section
163 section

What is claimed is:

1. An apparatus for making an album leaf from a image bearing sheet having image bearing side and a non-image bearing side, comprising:

a supply of adhesive sheet material;

a first roller about which said image bearing sheet is driven;

a second roller positioned adjacent said first roller so as to form a first nip there between, said second roller is used for driving the adhesive sheet into said first nip against said image bearing sheet that is driven by said first roller; and a third roller positioned adjacent said first roller so as to form a second nip there between, said third and said first roller moving in a direction which caused said image bearing sheet to be folded firmly about said adhesive sheet and move through said second nip so a to form an album leaf.

2. An apparatus according to claim 1 wherein said first roller has securing mechanism for securing said image bearing sheet to said first roller for a selected period of time.

3. An apparatus according to claim 2 wherein said securing mechanism comprises providing a line of vacuum.

4. An apparatus according to claim 1 wherein said adhesive sheet is smaller in size than said folded image bearing sheet.

5. An apparatus according to claim 4 wherein a trimming device is provided for trimming at least one of the sides of said folded image bearing sheet which has edges and said trimming occurs in area where said sheet is provided.

6. An apparatus according to claim 1 wherein a trimming device is provided for trimming at least one of the sides of said album leaf which has edges.

7. An apparatus according to claim 6 wherein a detachable trimmed section is left attached to said album leaf for later removal.

8. An apparatus according to claim 7 wherein said trimmed section contains information.

9. An apparatus according to claim 8 wherein said information may be used for associating said album leaf with a customer order.

10. An apparatus according to claim 9 wherein said information is provided in a machine readable form.

11. An apparatus according to claim 9 wherein said information is provided in a human readable form.

12. An apparatus according to claim 1 wherein said image bearing sheet is initially supplied on a web of media and is cut into said image bearing sheets.

13. An apparatus according to claim 1 wherein said adhesive sheet is initially supplied on a web and is cut into said adhesive sheets.

14. An apparatus according to claim 1 wherein said adhesive sheet includes a heat activated adhesive.

15. An apparatus according to claim 14 further comprising a heater for activating said heat activated adhesive for permanently securing said folded image bearing sheet.

16. An apparatus according to claim 1 further comprising a pressure applying device for applying a sealing pressure on said folded sheet.

17. An apparatus according to claim 1 wherein there is provided a mechanism for placing a score line on said sheet about which said sheet is folded.

18. An apparatus according to claim 17 wherein said mechanism for placing a score line on said sheet comprises a projection on said second roller that aligns with a recess in said first roller.

19. A method for making an album leaf, comprising the steps of:

providing an image bearing sheet having an image bearing side having a first image section and a second image section separated by a fold line;

providing a supply of adhesive sheet material;

providing a first roller for transporting of said image bearing sheet;

providing a second roller for transporting of the adhesive sheet having a leading edge, said first roller and said second roller being position adjacent each other so as to form a first nip;

providing a third roller for transporting of said sheet and said adhesive sheet, said first roller and said third roller being position adjacent each other so as to form a second nip;

transporting said image bearing sheet using a first roller and said adhesive sheet using a second roller in the same direction through said first nip so that said leading edge of said adhesive sheet is substantially aligned with said fold line during said transporting;

disengaging said adhesive sheet from said second roller onto said image bearing sheet;

moving said first and third rollers so that said image bearing sheet is folded about said fold line so as to form said album leaf.

20. A method according to claim 19 wherein said transporting of said sheet by said first roller is provided by a line of vacuum.

21. A method according to claim 19 further comprising the step of trimming at least one of the sides of said folded image bearing sheet which has edges.

22. A method according to claim 19 wherein said disengaging of said adhesive sheet from said second roller is accomplished by providing a burst of a gas.

23. A method according to claim 21 wherein said trimming results in providing a detachable trim section which contains information.

24. A method according to claim 23 wherein said information is used for associating said album leaf with a customer order.

25. A method according to claim 19 wherein said image bearing sheet is initially supplied on a web of media and is cut in to said image bearing sheets.

26. A method according to claim 19 wherein said adhesive sheet is initially supplied on a web and is cut into said adhesive sheets.

27. A method according to claim 19 wherein said adhesive sheet includes a heat activated adhesive.

28. A method according to claim 27 further comprising the step of applying heat to the heat activated adhesive for permanently securing said folded image bearing sheet.

29. A method according to claim 19 further comprising the step of applying a sealing pressure on said folded sheet.

30. A method according to claim 19 further comprising the step of placing a score line on said sheet about which said sheet is folded.

31. A method for making an album leaf from a image bearing sheet using a first roller, a second roller, and a third roller, said first roller and said second roller being position adjacent each other so as to form a first nip, said first roller and said third roller being position adjacent each other so as to form a second nip, said image bearing sheet having a first image section and a second image section, said first image section being separated from said second image section by a fold line, comprising the steps of:

feeding said image bearing sheet through said first nip using said first roller;

feeding an adhesive sheet through said first nip using said second roller, said adhesive sheet having a leading edge, said first and second roller being driven so that said leading edge is substantially aligned with said fold line;

disengaging said adhesive sheet from said second roller;

feeding said image bearing sheet and said adhesive sheet into said second nip so as to fold said image bearing sheet about said adhesive sheet.

* * * * *